US008870426B2

(12) United States Patent
Biebl et al.

(10) Patent No.: US 8,870,426 B2
(45) Date of Patent: Oct. 28, 2014

(54) ILLUMINATION UNIT FOR VEHICLE HEADLIGHTS AND VEHICLE HEADLIGHTS

(75) Inventors: Alois Biebl, St. Johann (DE); Peter Frey, Heidenheim (DE); Ralf Vollmer, Ulm (DE)

(73) Assignee: Osram AG, Munich (DE)

( * ) Notice: Subject to any disclaimer, the term of this patent is extended or adjusted under 35 U.S.C. 154(b) by 387 days.

(21) Appl. No.: 13/259,188

(22) PCT Filed: Mar. 29, 2010

(86) PCT No.: PCT/EP2010/054105

§ 371 (c)(1),
(2), (4) Date: Sep. 23, 2011

(87) PCT Pub. No.: WO2010/115755

PCT Pub. Date: Oct. 14, 2010

(65) Prior Publication Data

US 2012/0020104 A1 Jan. 26, 2012

(30) Foreign Application Priority Data

Apr. 8, 2009 (DE) ..... 10 2009 016 876

(51) Int. Cl.

| | |
|---|---|
| ***F21V 11/00*** | (2006.01) |
| ***F21V 15/01*** | (2006.01) |
| ***F21K 99/00*** | (2010.01) |
| ***F21V 25/00*** | (2006.01) |
| ***F21S 8/10*** | (2006.01) |
| *F21Y 101/02* | (2006.01) |

(52) U.S. Cl.

CPC ..... *F21V 25/00* (2013.01); *F21Y 2101/02* (2013.01); *F21K 9/00* (2013.01); *F21S 48/1109* (2013.01)

USPC ..... 362/546; 362/548

(58) Field of Classification Search

CPC .. F21S 48/1109; F21S 48/115; B60Q 1/0088; B60Q 1/0094

USPC ..... 362/546

See application file for complete search history.

(56) References Cited

U.S. PATENT DOCUMENTS 4,169,281 A * 9/1979 Brower et al. ..... 362/13
7,488,097 B2 * 2/2009 Reisenauer et al. ..... 362/373

(Continued)

FOREIGN PATENT DOCUMENTS

DE 102008031256 A1 1/2010
JP 11340515 A 12/1999
WO 2008065030 A1 6/2008

OTHER PUBLICATIONS

I. Schnitzer et al. 30 % external quantum efficiency from surface textures, thin-film light-emitting diodes Appl. Phys. Lett. 63 (16); Oct. 18, 1993; pp. 2174-2176.

(Continued)

*Primary Examiner* — David J Makiya

(57) ABSTRACT

An illumination unit for vehicle headlights may include a light-emitting diode device, a housing and an assembly board on which components of an operating circuit for operating the light-emitting diode device are arranged, wherein the housing and the assembly board define an interior space, wherein the assembly board has at least one electrically conductive inner layer that is connected to a ground reference potential of the operating circuit and on its surface the assembly board has at least one electrical contact surface which is contacted with at least one electrically conductive inner layer, and the housing has an electromagnetic shielding structure configured to provide electromagnetic shielding of the interior space, wherein the electromagnetic shielding structure is connected to the at least one electrical contact surface.

10 Claims, 9 Drawing Sheets

(56) References Cited

U.S. PATENT DOCUMENTS

| | | | | |
|---|---|---|---|---|
| 7,758,223 | B2 * | 7/2010 | Osawa et al. | 362/547 |
| 7,976,182 | B2 * | 7/2011 | Ribarich | 362/221 |
| 8,449,169 | B2 * | 5/2013 | Maslowski et al. | 362/646 |
| 8,529,095 | B2 * | 9/2013 | Konaka | 362/294 |
| 2005/0139854 | A1 | 6/2005 | Seki | |
| 2005/0254246 | A1 * | 11/2005 | Huang | 362/362 |
| 2007/0177401 | A1 * | 8/2007 | Nakabayashi | 362/548 |
| 2008/0186704 | A1 * | 8/2008 | Chou et al. | 362/249 |
| 2008/0266892 | A1 * | 10/2008 | Yashiki et al. | 362/546 |
| 2009/0175041 | A1 * | 7/2009 | Yuen et al. | 362/294 |
| 2010/0002444 | A1 * | 1/2010 | Konaka | 362/294 |
| 2010/0033972 | A1 * | 2/2010 | Maglica et al. | 362/294 |
| 2010/0067248 | A1 | 3/2010 | Frey et al. | |
| 2010/0128479 | A1 * | 5/2010 | Biebl et al. | 362/249.02 |
| 2011/0101861 | A1 * | 5/2011 | Yoo | 315/35 |
| 2011/0103076 | A1 | 5/2011 | Beck et al. | |

OTHER PUBLICATIONS

English abstract of JP 11340515 A.

* cited by examiner

ILLUMINATION UNIT FOR VEHICLE HEADLIGHTS AND VEHICLE HEADLIGHTS

RELATED APPLICATIONS

The present application is a national stage entry according to 35 U.S.C. §371 of PCT application No.: PCT/EP2010/054105 filed on Mar. 29, 2010, which claims priority from German application No.: 10 2009 016 876.1 filed on Apr. 8, 2009.

TECHNICAL FIELD

Various embodiments relate to an illumination unit and to a vehicle headlight having an illumination unit of said type.

BACKGROUND

An illumination unit of said type is disclosed in WO 2008/065030 A1, for example. Said specification describes an illumination unit for a vehicle headlight having a light-emitting diode device and a metallic housing which at least partially encloses the light-emitting diode device and which is provided with fastening means allowing the illumination unit to be installed in a vehicle headlight. Said fastening means are embodied so as to enable the light-emitting diode chips to be aligned with respect to the lens system of the vehicle headlight. The metallic housing can be connected to a heatsink in order to cool the light-emitting diode chips and serve to provide electromagnetic shielding of components of an operating circuit that are arranged therein. However, production of the metallic housing is comparatively labor-intensive and costly.

SUMMARY

Various embodiments provide a generic illumination unit having a less expensive housing and affording electromagnetic shielding for the electrical components of the operating circuit that are arranged in the housing.

The illumination unit for vehicle headlights in accordance with various embodiments has a light-emitting diode device, a housing and an assembly board on which the components of an operating circuit for operating the light-emitting diode device are arranged, wherein the housing and the assembly board define an interior space. According to various embodiments the assembly board has an electrically conductive inner layer that is connected to a ground reference potential of the operating circuit, and arranged on the surface of the assembly board is at least one electrical contact surface that is contacted with the aforesaid electrically conductive inner layer is connected to electromagnetic shielding means of the housing for the purpose of providing electromagnetic shielding of the interior space. The term "inner layer" implies that the assembly board of the illumination unit according to various embodiments has a plurality of layers and the aforesaid electrically conductive inner layer is an intermediate layer which is arranged between top side and underside of the assembly board. The top side and underside of the assembly board may be embodied as electrically insulating in order to enable conductor tracks or electrical contacts for components to be applied and thereby allow both sides of the assembly board to be populated with components.

The electrically conductive inner layer and the shielding means of the housing which are connected to the aforesaid electrically conductive inner layer via the at least one electrical contact surface on the surface of the assembly board effect inexpensive electromagnetic shielding of the interior space of the housing since as a result of these measures the housing can be manufactured from plastic, for example using injection-molding technology, and need not be embodied as a metal housing. Preferably those components of the operating circuit of the light-emitting diode device are arranged in the thus shielded interior space of the housing and which during operation generate signals having a high-frequency component which could interfere with the radio or television reception in the vehicle or interfere with electronic systems.

The at least one electrical contact surface is arranged on at least one side of the assembly board. Preferably the at least one electrical contact surface also extends over the edge of the assembly board onto the other side of the assembly board in order to ensure a good connection with the electromagnetic shielding means and the electrically conductive layer of the assembly board lying at ground reference potential. In the case of a soldered connection between the at least one electrical contact surface and the electromagnetic shielding means it is sufficient for the at least one electrical contact surface to be arranged on one side of the assembly board only. The aforesaid electrically conductive inner layer at ground reference potential is preferably a layer of the preferably multilayered assembly board extending over the entire area of the assembly board. The electrical contacting of said inner layer at ground reference potential with the at least one electrical contact surface of the assembly board can advantageously be provided by means of one or more metallic pins which are inserted into continuous holes drilled in the assembly board in the area of the annular electrical contact surface.

The contact between the electrically conductive inner layer of the assembly board at ground reference potential and the electromagnetic shielding means of the housing can be established, for example, by means of one or more electrical contact surfaces which are arranged separated from one another on the surface of the assembly board and which are each in electrical contact with the inner layer of the assembly board. The aforesaid separate contact surfaces can, for example, be advantageously arranged along the edge of the assembly board.

In order to ensure optimum shielding, the at least one electrical contact surface arranged on the surface of the assembly board is preferably embodied as ring-shaped, in other words, the electrical contact surface preferably forms a closed curve which particularly preferably runs along the edge or close to the edge of the assembly board. The term "ring-shaped" therefore includes not only annular and circular but also closed curves in other shapes such as ovals and polygons, for example. The shape of the contact surface embodied as ring-shaped is preferably determined by the shape of the edge of the assembly board.

According to a preferred exemplary embodiment of the invention, the housing consists of electrically insulating material, in particular of plastic, and the electromagnetic shielding means are embodied as metallization of the housing or of the housing section enclosing the interior space. As a result the housing can be produced using plastic injection-molding technology and by means of the aforesaid metallization a housing having an electromagnetically shielded interior space can be realized in a particularly economical way.

The aforesaid metallization is preferably embodied as a metallic coating which is preferably applied on the inside of the housing section surrounding the interior space. The metallic coating is preferably one or more layers of one or more of the metals from the group including aluminum, copper, brass, zinc, nickel, chrome and iron. An aluminum coating is particularly preferred. As an alternative to metallization, a nonmetallic, electrically conductive coating, for example, an indium-tin oxide coating (ITO layer) can also be used.

In order to establish an electrical connection between the aforesaid metallization of the housing and the electrical contact surface of the assembly board in the simplest and most reliable way, the metallization also extends advantageously onto a supporting surface which is defined by the housing and on which is seated the assembly board with its electrical contact surface.

In addition or alternatively, the electrical connection between the contact surface of the assembly board and the metallization on the housing can be established by means of an electrically conductive sealing ring which is arranged between the housing and the assembly board, or by means of an electrically conductive contact ring which is arranged between the shielding and the at least one electrical contact surface on the surface of the assembly board. The aforesaid contact ring can be embodied as spring-mounted or can also be replaced by an electrically conductive spring element in order to ensure a reliable electrical contact between the shielding means and the at least one electrical contact surface.

Alternatively or in addition to the aforesaid metallization of the housing, the shielding means may also include at least one metal sheet, metal lattice, metal mesh or metal film in order to ensure electromagnetic shielding of electrical components of the operating circuit that are arranged in the interior space of the housing. For this purpose the at least one metal sheet, metal lattice, metal mesh or metal film is advantageously shaped so as to form a receptacle for the electrical components of the operating circuit that are to be shielded, and as a result, taken in combination with the electrically conductive layer of the assembly board lying at ground reference potential, an electromagnetically fully shielded space is formed inside the housing. Preferably the at least one metal sheet, metal lattice, metal mesh or metal film is therefore embodied in the shape of a bowl. The at least one metal sheet, metal lattice, metal mesh or metal film preferably includes one or more of the metals from the group including copper, copper-zinc alloy, aluminum, stainless steel and galvanized steel.

In order to simplify production, the housing is advantageously embodied as a plastic injection-molded part and the at least one metal sheet, metal lattice, metal mesh or metal film is extrusion-coated with the injected housing material or is partially embedded in the housing material by means of injection-molding technology.

In order to achieve a good connection of the at least one metal sheet, metal lattice, metal mesh or metal film to the ground reference potential of the operating circuit as simply as possible, the at least one metal sheet, metal lattice, metal mesh or metal film advantageously bears against the at least one electrical contact surface of the assembly board. In addition or alternatively, the at least one metal sheet, metal lattice, metal mesh or metal film can also be connected to the ground reference potential of the operating circuit via a metallic heatsink. Preferably the at least one metal sheet, metal lattice, metal mesh or metal film is connected to the ground reference potential of the operating circuit at a plurality of points in order to ensure good electromagnetic shielding.

The at least one metal sheet, metal lattice, metal mesh or metal film is preferably fixed to the assembly board by means of a technology from the group including flanging, laser welding, adhesive bonding, soldering and force fitting in order to ensure a reliable fixing of the assembly board in the housing and a reliable electrical contact between the at least one electrical contact surface of the assembly board and the at least one metal sheet, metal lattice, metal mesh or metal film.

In addition to or instead of the electromagnetic shielding means already described above, the electromagnetic shielding means may also include a housing section which consists of electrically conductive plastic and encloses the interior space of the housing.

The aforesaid housing section consisting of electrically conductive plastic advantageously forms a supporting layer for the at least one electrical contact surface in order to enable said housing section to be electrically connected to the ground reference potential of the operating circuit in a simple manner.

One or more of the illumination units according to the invention are preferably used as a light source in a vehicle headlight in order, for example, to generate light for fog lamps or for daytime running lamps.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
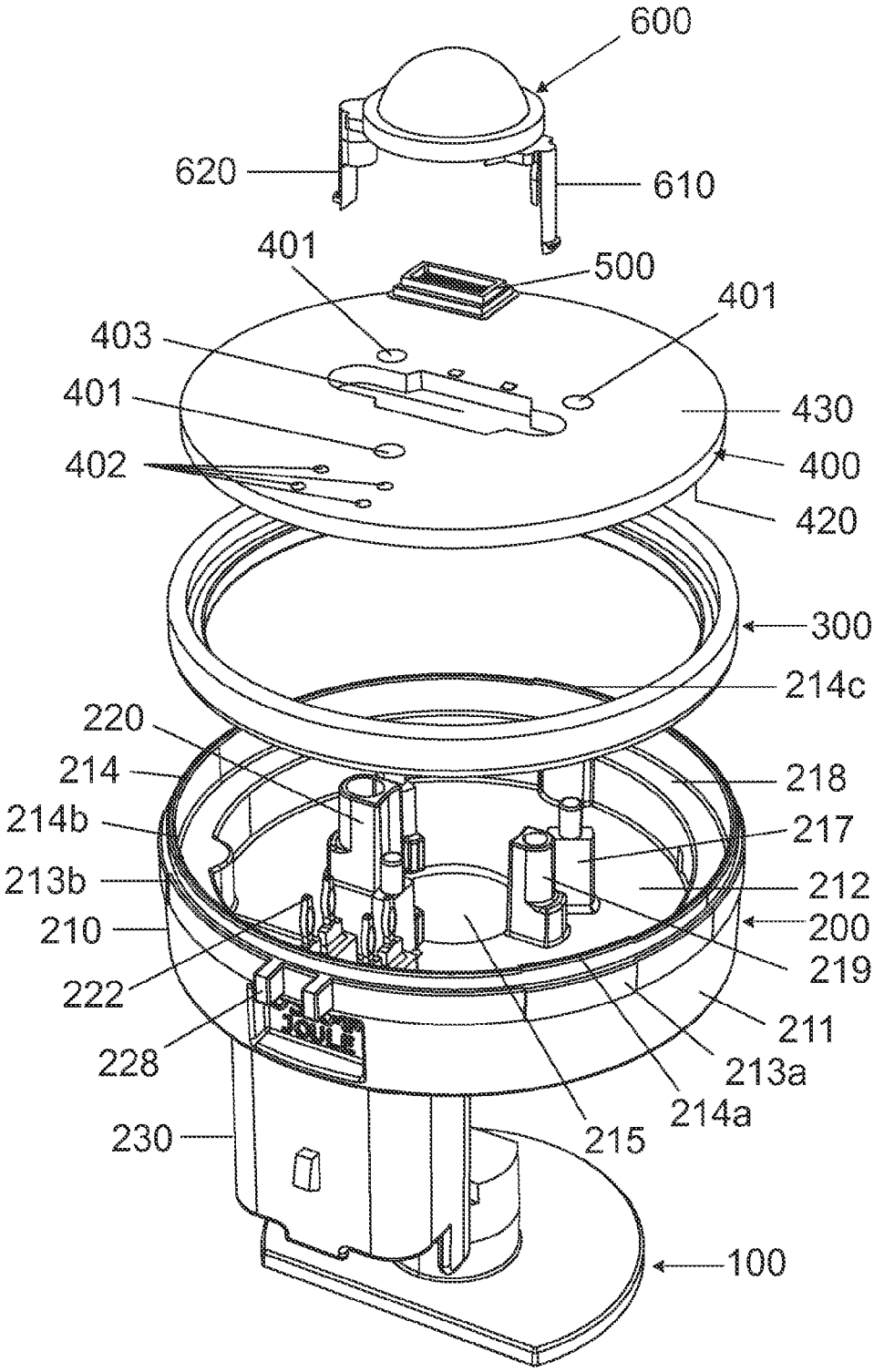
FIG. 1 is a schematic illustrating all the components of the illumination unit according to the first exemplary embodiment of the invention in an exploded view of the illumination unit
Figure 2:
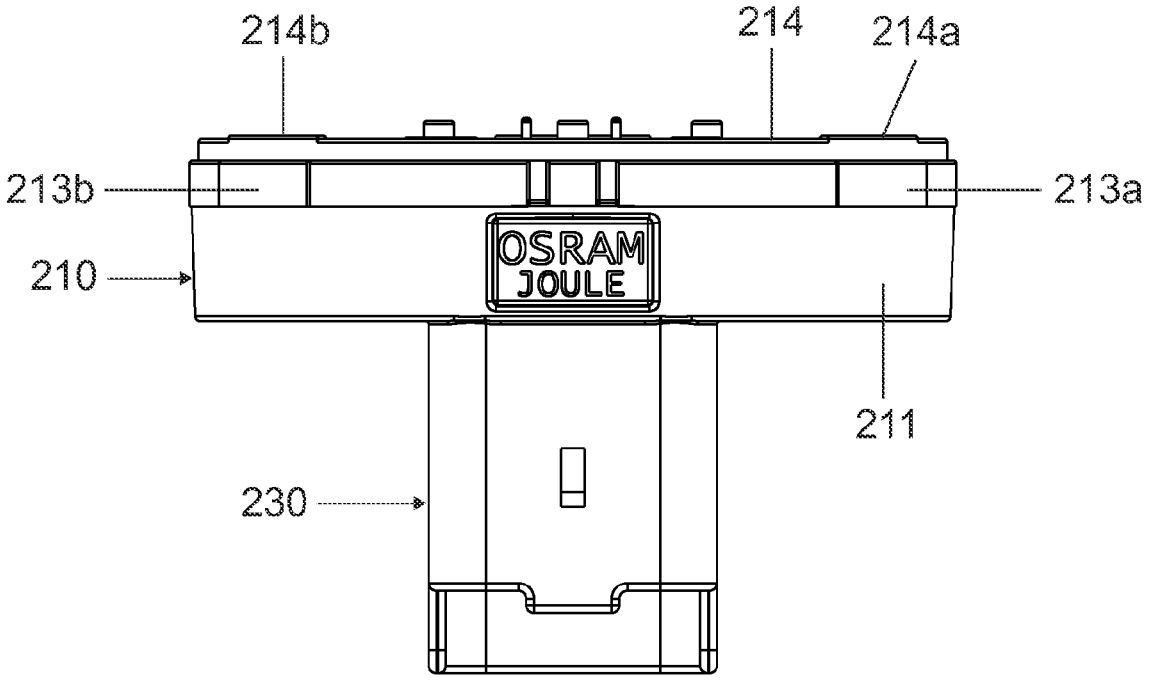
FIG. 2 shows a side view of the housing of the illumination unit of the housing illustrated in FIG. 1
Figure 3:
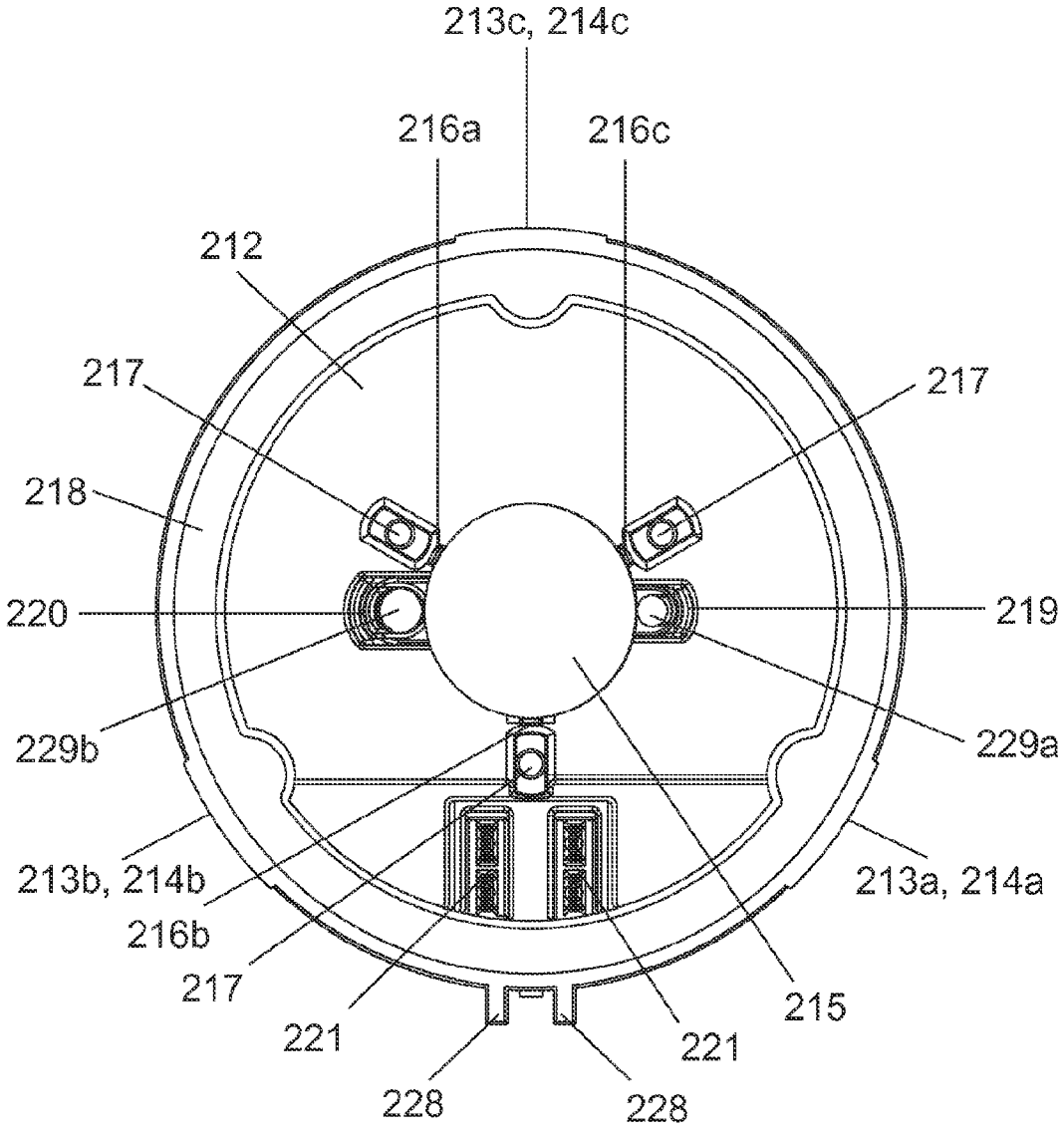
FIG. 3 shows a front view of the housing illustrated in FIG. 2
Figure 4:
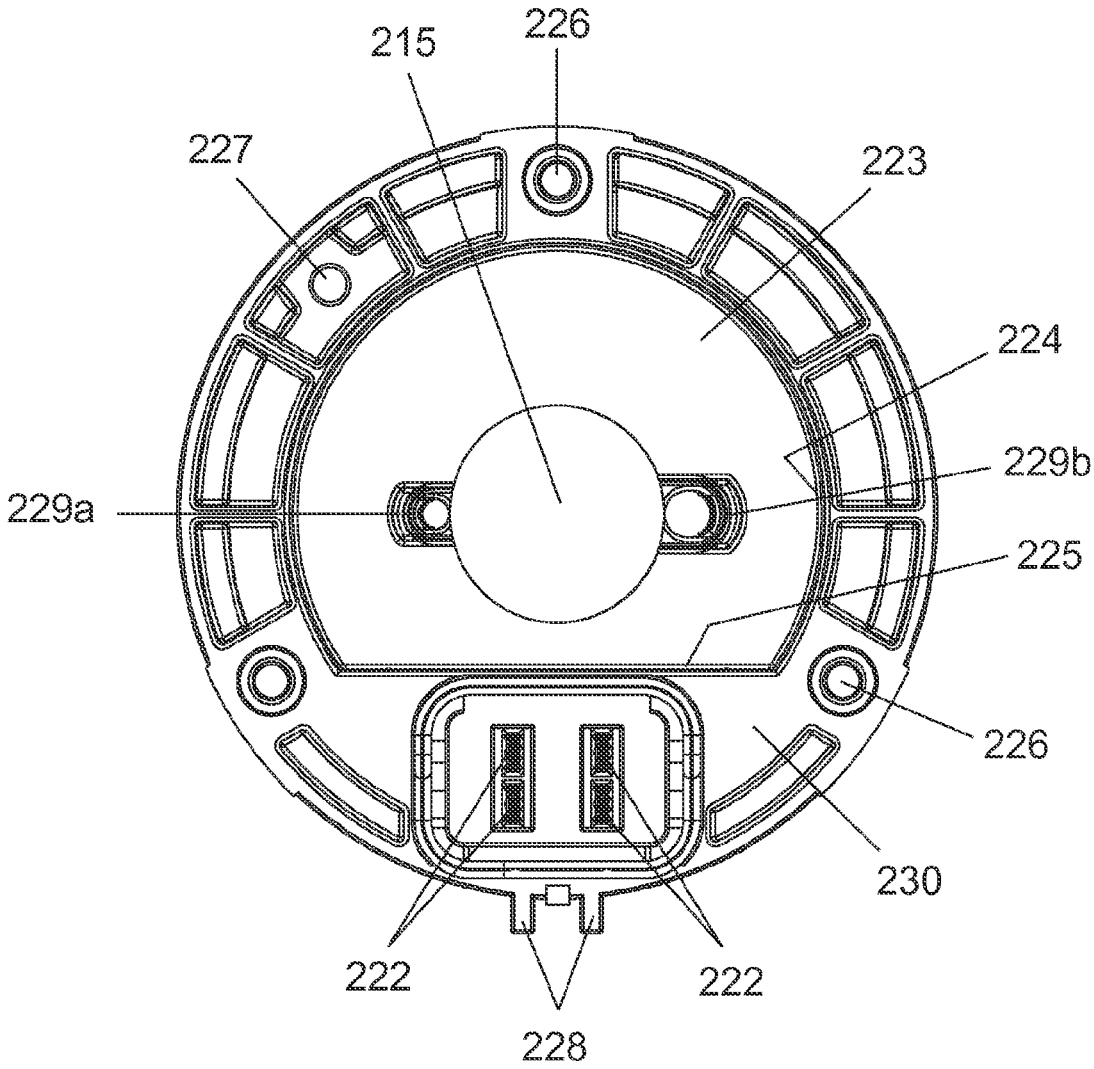
FIG. 4 shows a rear view of the housing illustrated in FIGS. 2 and 3

The illumination unit according to the first exemplary embodiment of the invention has a housing 200 embodied as a plastic injection-molded part, a metallic heatsink 100 made of aluminum, a sealing ring 300 made of rubber or silicone, an assembly board 400 with electrical components (not shown) arranged thereon and conductor tracks (not shown) as well as contact surfaces (not shown), a light-emitting diode device 500 and primary lens system 600. FIG. 1 shows an exploded view of the illumination unit with its individual components. The aforesaid components of said illumination unit and their interaction are described in more detail below.

Figure 11:
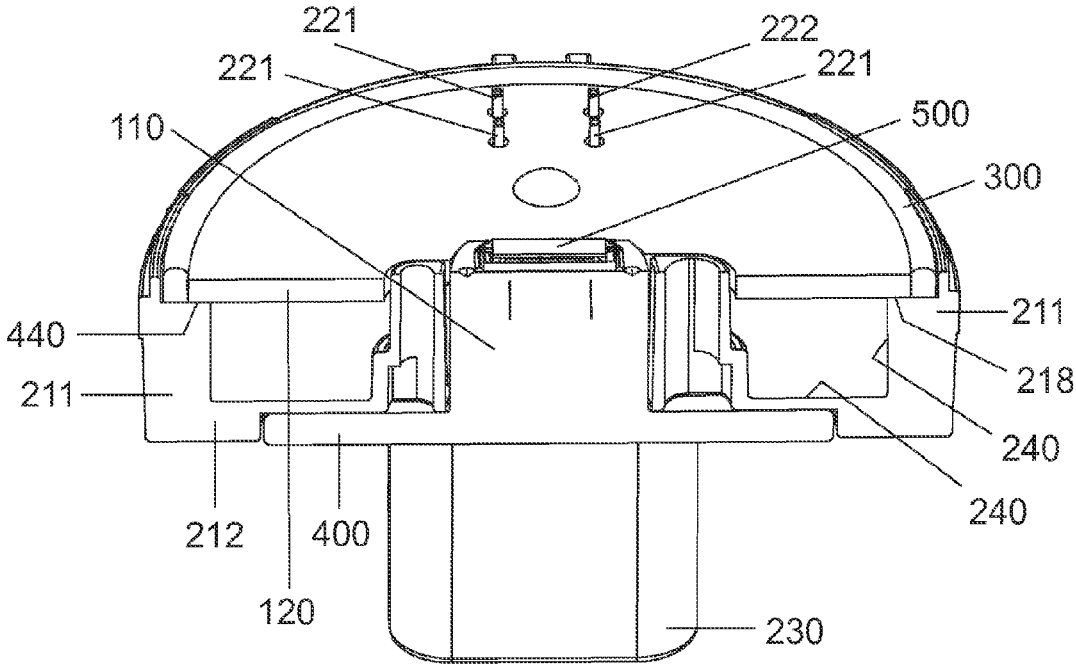
FIG. 11 shows a schematic view of the illumination unit illustrated in FIG. 9 in cross-section

Details of the housing 200 are depicted in particular in FIGS. 2 to 4 and 11. The housing 200 is embodied in a single piece as a plastic injection-molded part. It has a hollow cylindrical housing section 210 and a housing section 230 embodied as a connector. The hollow cylindrical housing section 210 has a circular cylindrical side wall 211 and a base 212. The inside of the base 212 and the circular cylindrical side wall 211 is provided with metallization 240 in the form of an aluminum coating. The hollow cylindrical housing section 210 has an external diameter of 50 millimeters. The circular cylindrical side wall 211 is provided with three protrusions 213*a*, 213*b*, 213*c* which are disposed equidistantly along its external lateral surface and at the same height above the base 212 and which protrude outward from the lateral surface and serve as a means of adjustment for aligning the illumination unit in the vehicle headlight. In particular said three protrusions 213*a*, 213*b*, 213*c* define a reference external diameter of the hollow cylindrical housing section 210 for aligning the illumination unit in the vehicle headlight. The wall strength of the circular cylindrical side wall 211 is increased by the protrusions 213*a*, 213*b*, 213*c* in this area and the side wall 211 consequently forms a reference for the adjustment of the illumination unit in an optical system in the headlamp. The upper edge 214 of the hollow cylindrical housing section 210 is provided with three bridges 214*a*, 214*b*, 214*c* arranged equidistantly along the circumference of the hollow cylindrical housing section 210. Said three bridges 214*a*, 214*b*, 214*c* form ring segments which are integrally molded onto the upper edge 214 of the circular cylindrical side wall 211, are arranged on a radius and extend in the direction of the cylinder axis of the circular cylindrical side wall 211. The width of said bridges 214*a*, 214*b*, 214*c*, in other words, their extension in the circumferential direction of the circular cylindrical side wall 211, corresponds to the width or extension of the protrusions 213*a*, 213*b*, 213*c* along the external lateral surface of the circular cylindrical side wall 211. The bridges 214*a*, 214*b*, 214*c* are arranged along the circumference of the circular cylindrical side wall 211 at the same points as the protrusions 213*a*, 213*b*, 213*c*. The upper edges of the three bridges 214*a*, 214*b*, 214*c* define a plane which runs normal to the cylinder axis of the hollow cylindrical housing section 210 and serves as the reference plane for the alignment of the light-emitting diode device 500. The housing section 230 embodied as a connector is integrally molded off-center with respect to the base 212 of the hollow cylindrical housing section 210 on the reverse side. The base 212 has a circular disk-shaped aperture 215 arranged coaxially to the cylinder axis of the hollow cylindrical housing section 210, through which a column-like section 110 of the metallic heatsink 100 protrudes. On the inside of the hollow cylindrical housing section 210 the base 212 is fitted with three pins 216*a*, 216*b*, 216*c* which are arranged at equidistant intervals along the edge of the circular disk-shaped aperture 215 and extend parallel to the direction of the cylinder axis of the hollow cylindrical housing section 210. Said pins 216*a*, 216*b*, 216*c* are disposed on a circular cylindrical subsection 111 of the column-like section 110 of the metallic heatsink 100 and serve for aligning the metallic heatsink 100 in the plastic housing 200. In particular, the pins 216*a*, 216*b*, 216*c* ensure a play-free seating of the metallic heatsink 100 in the housing 200 and prevent movements of the metallic heatsink 100 in all directions normal to the cylinder axis of the hollow cylindrical housing section 210. On the inside the base 212 is provided with three further pins 217 which likewise extend parallel to the cylinder axis of the hollow cylindrical housing section 210 and serve for fixing the assembly board 400. In particular, the tapered ends of said pins 217 protrude through apertures 401 in the assembly board 400 and are hot-calked on the top side, in other words on the side of the assembly board 400 facing away from the base 212. On its inside the circular cylindrical side wall 211 has an annular collar 218 on which the sealing ring 300 and the assembly board 400 are seated (FIG. 11). The metallization 240 of the inside of the side wall 211 extends from the base 212 to the level of the collar 218 and additionally also extends onto the supporting surface for the assembly board 400 that is formed by the collar 218. In addition, the base 212 is fitted with two hollow bridges 219, 220 which extend parallel to the cylinder axis of the hollow cylindrical housing section 210 and are arranged diametrically on the edge of the circular disk-shaped aperture 215. Said bridges 219, 220 serve to fix the primary lens system 600. Attached in the hollow space of the bridges 219, 220 are projections 229*a*, 229*b* behind which the retaining fixture 610, 620 of the primary lens system 600 latches into place. Protruding from the base 212 are a plurality of metal pins 221, 222 which are connected in an electrically conductive manner to electrical terminals of the illumination unit embedded in the connector 230 and which protrude through apertures 402 in the assembly board 400 and are soldered or welded to conductor tracks or contact surfaces on the assembly board 400 or are contacted by means of a press-fit or press-in zone. The electrical terminals are also connected to metallic contact pins 222 which protrude from the plastic material of the connector 230 and are accessible on the reverse side of the illumination unit or of the housing section 230 embodied as a connector. On the external side or reverse side of the hollow cylindrical housing section 210 the base 212 has a precision-fit recess 223 for a disk-shaped section 120 of the metallic heatsink 100. Said recess 223 is delimited by a circular arc-shaped wall section 224 and a straight wall section 225. By means of said non-rotationally symmetrical geometry of the recess 223 and of the disk-shaped section 120 of the metallic heatsink 100 an anti-twist locking mechanism is realized which prevents rotations of the metallic heatsink 100 around the axis of its cylindrical subsection 111 in the aperture 215 in the base 212 of the hollow cylindrical housing section 210. In the base 212 there are three threaded sockets 226 annularly and equidistantly arranged on the reverse side or external side of the hollow cylindrical housing section 210 which are embedded and anchored in the plastic material of the housing section 210 in such a way that their screw thread is accessible for screw on an external cooling system. In addition, on the reverse side of the hollow cylindrical housing section 210 there is a pressure equalization hole 227 which in particular in the case of closed systems enables pressure equalization in the vehicle headlight. Said pressure equalization hole 227 is optional and may be covered by means of a pressure equalization diaphragm (not shown). Protruding from the outside of the circular cylindrical side wall 211 are two reference lugs 228 which serve as a reference for the alignment of the illumination unit in the vehicle headlight. In particular, said reference lugs 228 define a clearly identifiable mounting position of the illumination unit in the vehicle headlight.

Figure 5:
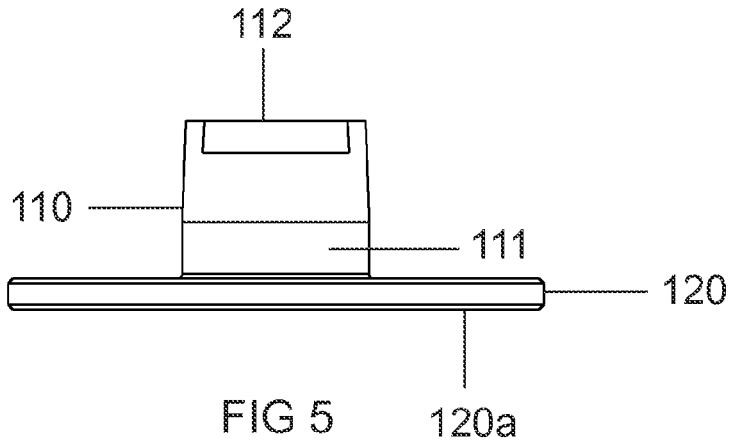
FIG. 5 shows a side view of the metallic heatsink of the illumination unit depicted in FIG. 1
Figure 6:
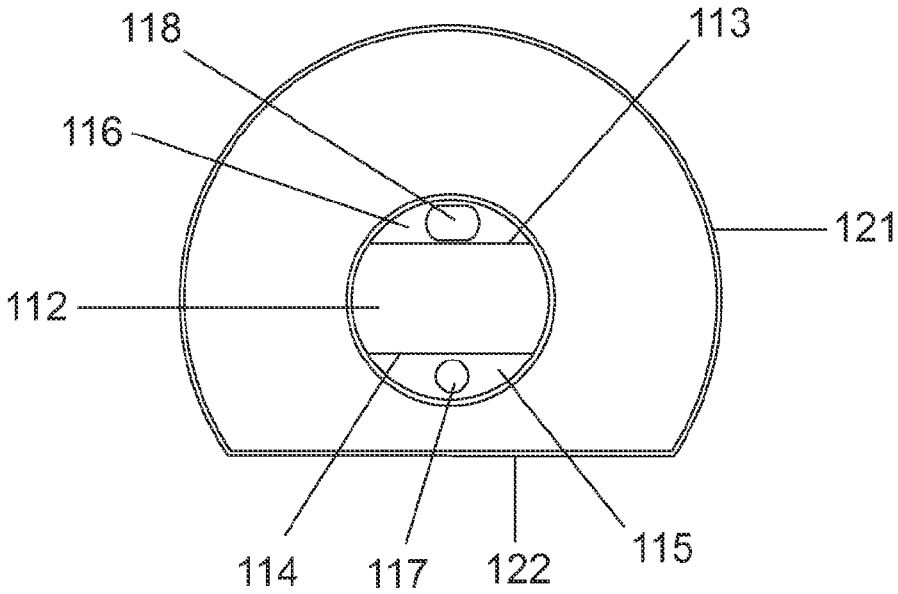
FIG. 6 shows a front view of the metallic heatsink illustrated in FIG. 5
Figure 7:
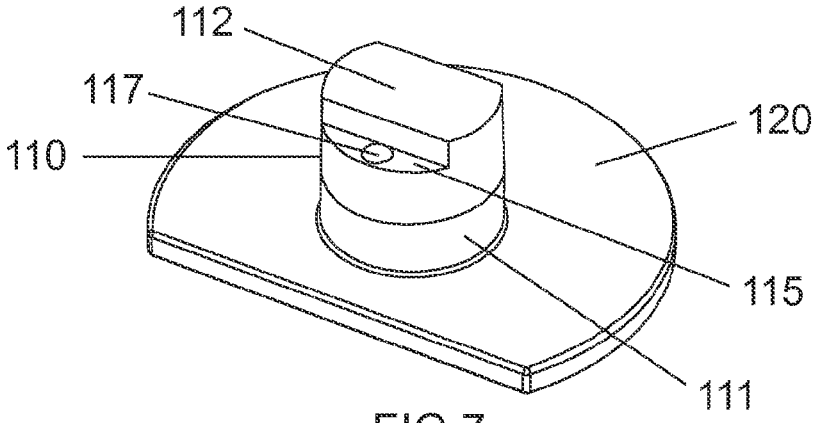
FIG. 7 shows a perspective view of the metallic heatsink illustrated in FIGS. 5 and 6
Figure 8:
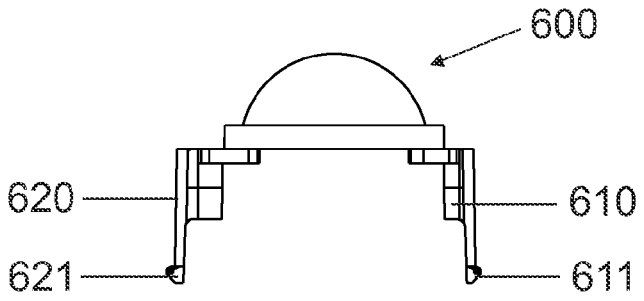
FIG. 8 shows a side view of the primary lens of the illumination unit illustrated in FIG. 1
Figure 12:
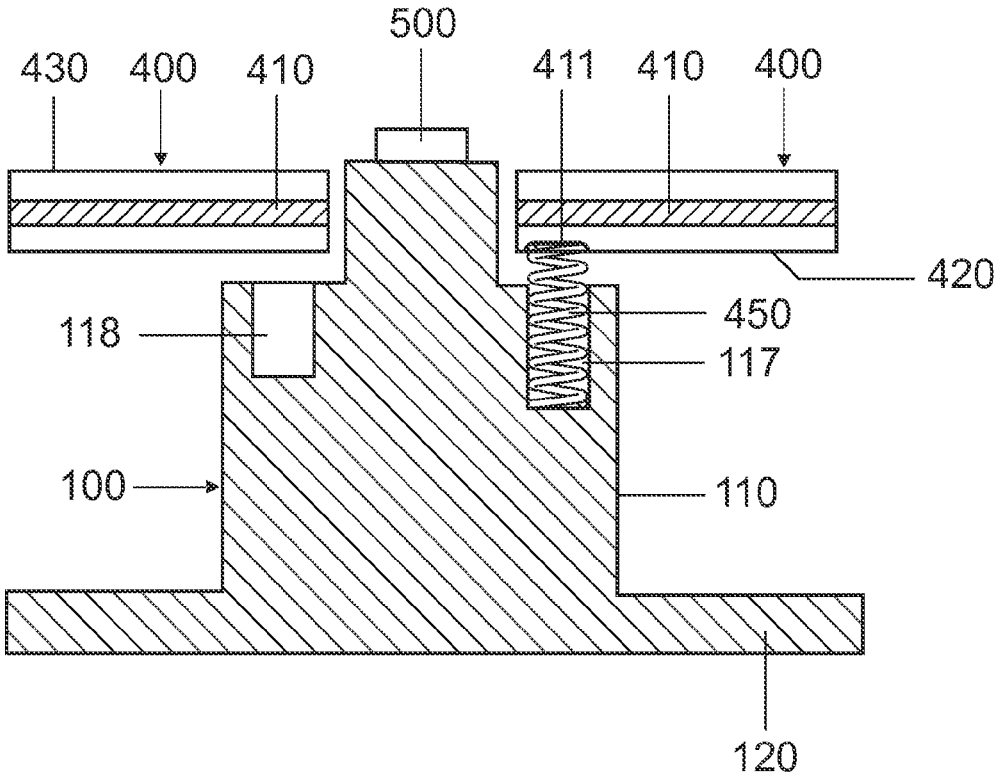
FIG. 12 shows a schematic, partially sectioned view of the heatsink and the assembly board of the illumination unit illustrated in FIG. 11

Details of the metallic heatsink 100 are illustrated in FIGS. 5 to 7. It is embodied as a single part and is made of aluminum. The metallic heatsink 100 consists of a column-like section 110 and a disk-shaped section 120 which is integrally molded at one end of the column-like section 110. The reverse side 120*a* of the disk-shaped section 120 of the metallic heatsink 100 facing away from the column-like section 110 serves as a supporting surface for an external cooling system. The column-like section 110 has a circular cylindrical partial section 111 which is directly adjacent to the disk-shaped section 120. The edge of the disk-shaped section 120 is formed by a circular arc-shaped edge section 121 and a straight edge section 122. The straight edge section 122 of the heatsink 100 is in contact with the straight wall section 225 in the recess 223. The column-like section 110 of the heatsink 100 protrudes through the aperture 215 in the base 212 of the hollow cylindrical housing section 210 and the circular cylindrical partial section 111 is in play-free contact with the pins 216*a*, 216*b*, 216*c*. At its end the column-like section 110 has a level assembly area 112 running parallel to the disk-shaped section 120 which is delimited by two side edges 113, 114 running parallel to each other. The light-emitting diode device 500 is adhesively attached on said assembly area 112 in well-defined alignment by means of an automatic placement machine. On both sides of the assembly area 112 there are surfaces 115, 116, each running parallel to the assembly area 112, which are arranged at a lower height above the disk-shaped section 120 and each have a depression 117, 118. The column-like section 110 of the heatsink 100 protrudes through an aperture 403 in the assembly board 400 such that the assembly area 112 lies in the plane defined by the upper edges of the bridges 214*a*, 214*b*, 214*c* and the metallic heatsink 100 is fixed to the housing 200 at this height by means of adhesive. A temperature sensor is arranged in the depression 118 embodied as a slotted hole and is thermally coupled to the heatsink by means of heat-conductive paste. The temperature sensor monitors the temperature of the light-emitting diode device 500 during the operation of the illumination unit. Arranged in the other depression 117 is a metal spring 450 which presses with spring effect against an electrical contact 411 at ground reference potential on the assembly board 400 (FIG. 12). As a result the metallic heatsink 100 is electrically connected to ground reference potential.

The sealing ring 300 is made of rubber or silicone and bears on the collar 218 on the inside of the circular cylindrical side wall 211. It serves to seal the illumination device in a vehicle headlight or a lamp.

Figure 10:
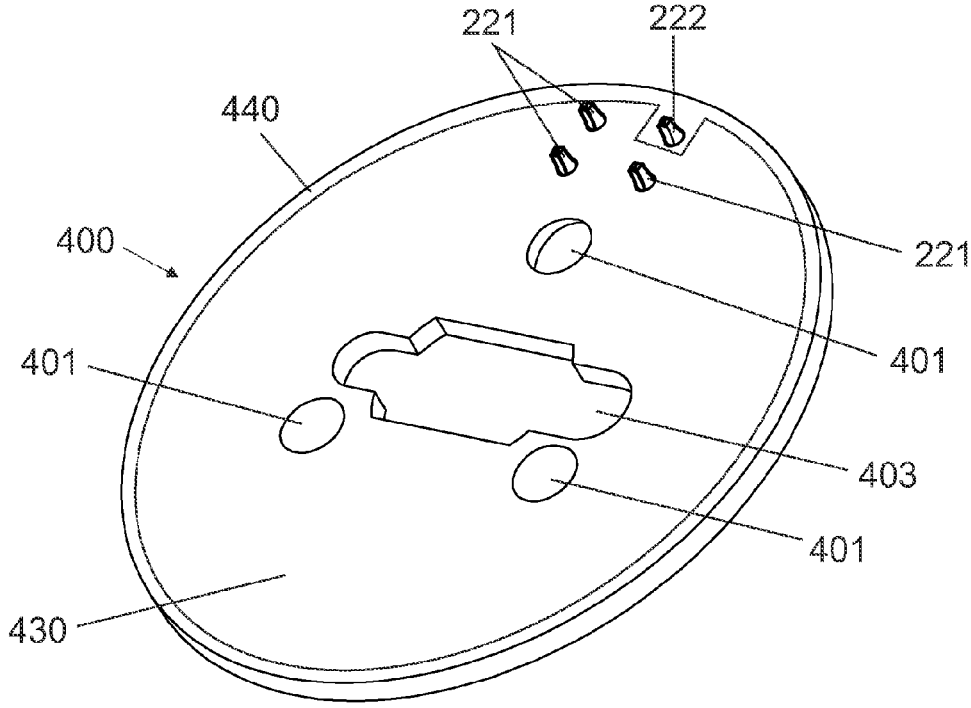
FIG. 10 shows a perspective view of the assembly board and the light-emitting diode chips of the illumination unit illustrated in FIG. 9

The assembly board 400 is embodied as circular disk-shaped and has a central aperture 403 through which there protrudes the column-like section 110 of the metallic heatsink 100 with the light-emitting diode device 500 fixed thereon. The assembly board 400, the circular cylindrical side wall 211 and the base 212 of the hollow cylindrical housing section 210 form an interior space. Electrical components (not shown) of an operating circuit for operating the light-emitting diode arrangement 500 are arranged on the reverse side 420 of the assembly board 400 facing toward the interior space and where necessary are interconnected by means of conductor tracks which are likewise arranged on the assembly board 400. Arranged on the front side 430 of the assembly board 400 are conductors (not shown) and electrical contact surfaces (not shown) for contacting the light-emitting diode device 500 and where necessary further components of the operating circuit which cannot cause high-frequency interference signals during its operation. The assembly board 400 is embodied as multilayered and in addition to the conductors on the front side and reverse side has an inner metal layer 410 which is embedded in the electrically insulating material of the assembly board 400 and is connected to the ground reference potential of the operating circuit for the light-emitting diode device 500 in order to increase the electromagnetic compatibility of the illumination unit. The aforesaid inner metal layer 410 lying at ground reference potential extends over the entire extension or the entire diameter of the assembly board 400 and together with the aforesaid metallization 240 on the inside of the base 212 and the side wall 211 forms an electromagnetic shield protecting the interior space of the hollow cylindrical housing section 210 of the illumination unit according to the first exemplary embodiment of the invention. The assembly board 400 has an annular electrical contact surface 440 which is connected in an electrically conductive manner to the inner metal layer 410 lying at ground reference potential. At least on the side 420 of the assembly board facing toward the base 212 the annular electrical contact surface 440 is arranged on the surface of the assembly board 400 and rests in contact with the metallized supporting surface of the collar 218 such that the metallization 240 of the collar 218 and the inside of the base 212 and side wall 211 is connected in an electrically conductive manner to the inner metal layer 410 and the ground reference potential of the operating circuit. Preferably the annular electrical contact surface 440 extends over the edge of the assembly board 400 in addition also onto the other side 430 of the assembly board 400 facing away from the base 212. This extension of the annular electric contact surface 440 onto the side 430 of the assembly board 400 is represented schematically in FIG. 10. Four metal pins 221, 222 which serve as electrical contact pins protrude through drilled holes in the assembly board 400. The annular electrical contact surface 440, which is embodied as a metallic coating, in particular as a copper conductor track, extends up to one of the two externally located metal pins 222. The metal pin 222 passes through both the annular electrical contact surface 440 and the inner metal layer 410 of the assembly board 400 and thus establishes an electrically conductive connection between the annular electrical contact surface 440 and the inner metal layer 410. The inner metal layer 410 of the assembly board 400 lying at ground reference potential is therefore plated-through by means of the metal pin 222 at least on one side 430 of the assembly board 400, though preferably on both sides 420, 430 of the assembly board 400. Instead of the metal pin 222, so-called vias in the assembly board can also be used in order to establish an electrically conductive connection between the inner metal layer 410 of the assembly board and the annular contact surface 440.

Preferably the metallic heatsink 100 is also at ground reference potential in addition in order to further improve the electromagnetic shielding or in order to couple other components of the lamp or the vehicle headlight into which the illumination unit is inserted to the ground reference potential of the operating circuit via the reverse side 120*a* of the disk-shaped section 120 of the metallic heatsink 100. In this way the electromagnetic shielding can be extended to protect the entire lamp or the entire vehicle headlight.

The inner metal layer 410 is also plated-through to the electrical contact surface 411 on the reverse side 420 of the assembly board 400 with which the metal spring 450 arranged in the depression 117 of the metallic heatsink 100 is in contact by means of a force fit and spring effect. The metal spring 450 consists of a wire which is helically wound. The electrically conductive metal spring 450 consists of spring steel or copper, for example. With the aid of the metal spring 450 the metallic heatsink 100 is connected in an electrically conductive manner via the contact surface 411 and the inner metal layer 410 of the assembly board 400 to the ground reference potential of the operating circuit. Instead of the helical metal spring 450 illustrated in FIG. 12 a metallic leaf spring can also be used.

The components (not shown) mounted on the reverse side 420 of the assembly board 400 of the operating circuit are arranged in the interior space which is formed by the side wall 211 and the assembly board 400. As a result the inner metal layer 410 of the assembly board 400 and the metallization 240 on the inside of the base 212 and the side wall 211 of the hollow cylindrical housing section 210 form an electromagnetic shield for the components of the operating circuit mounted on the reverse side 420 of the assembly board 400. In order to prevent any high-frequency electromagnetic interference signals from being conducted to the exterior via the electrical wiring and terminals of the illumination unit, the operating circuit has at its voltage input a filter for high-frequency signals, for example a lowpass filter or a bandpass filter, in order to attenuate interference signals with frequencies greater than 0.15 MHz.

The assembly board 400 is provided with three drilled holes 401 which are arranged around the central aperture 403. After its assembly the assembly board 400 is mounted on the pins 217 such that their tapered ends protrude through the apertures 401. The assembly board 400 is fixed to the housing 200 by means of hot-calking of the tapered ends of the pins 217. The assembly board 400 additionally has four further drilled holes 402 which are arranged at its edge, above the housing section 230 embodied as a connector, and through which the metal pins 221, 222 protrude in order to enable an electrically conductive connection to contact surfaces on the front side of the assembly board 400. The central aperture 403 in the assembly board 400 is embodied such that the retaining fixtures 610, 620 of the primary lens system 600 also protrude through the aperture 403 and can engage in the hollow bridges 219, 220.

The light-emitting diode device 500 consists of five light-emitting diode chips which are arranged in a row on a carrier plate and are enclosed by the walls of a frame. Said light-emitting diode chips are provided with a fluorescent coating (chip-layer coating) which partially converts the blue light generated by the light-emitting diode chips into light of other wavelengths such that during its operation the illumination unit emits light which appears white. The light-emitting diode chips are, for example, thin-film light-emitting diode chips whose basic principle is described, for example, in the publication I. Schnitzer et al., Appl. Phys. Lett. 63 (16), 18 Oct. 1993, 2174-2176. The light-emitting diode device 500 is connected in an electrically conductive manner to electrical contacts on the assembly board 400 and is operated with the aid of the operating circuit whose components are arranged on the assembly board 400. The operating circuit supplies the light-emitting diode chips of the light-emitting diode device 500 with electric current and with the aid of the aforesaid temperature sensor enables the electrical power consumption of the light-emitting diode device 500 to be regulated as a function of the temperature of the light-emitting diode device 500. In the event of imminent overheating of the light-emitting diode device 500, the power provided by the operating circuit for the light-emitting diode device 500 can be reduced, for example. For this purpose the temperature sensor can be embodied for example as a temperature-dependent resistor, in particular as an NTC resistor with negative temperature characteristics.

The primary lens system 600 includes a transparent, dome-shaped cover of the light-emitting diode device 500 and is made of plastic or glass. The primary lens system 600 has two hook-shaped retaining fixtures 610, 620 which are introduced into the hollow bridges 219, 220 and the hooks 611, 621 thereof latch into place there behind the projections 229*a*, 229*b*. The bridge 220 is provided with a slotted hole with an oval cross-section, while the bridge 219 has a hollow space with a circular edge. By this means a clearly defined orientation can also be predetermined for the primary lens system 600. This is important if the transparent dome-shaped cover 600 is replaced by a primary lens system with light-directing properties. However, the dome-shaped cover 600 can also be omitted or be replaced by a primary lens system with focusing or light-directing properties which directs or concentrates the light from the light-emitting diode device in predetermined spatial directions.

Figure 9:
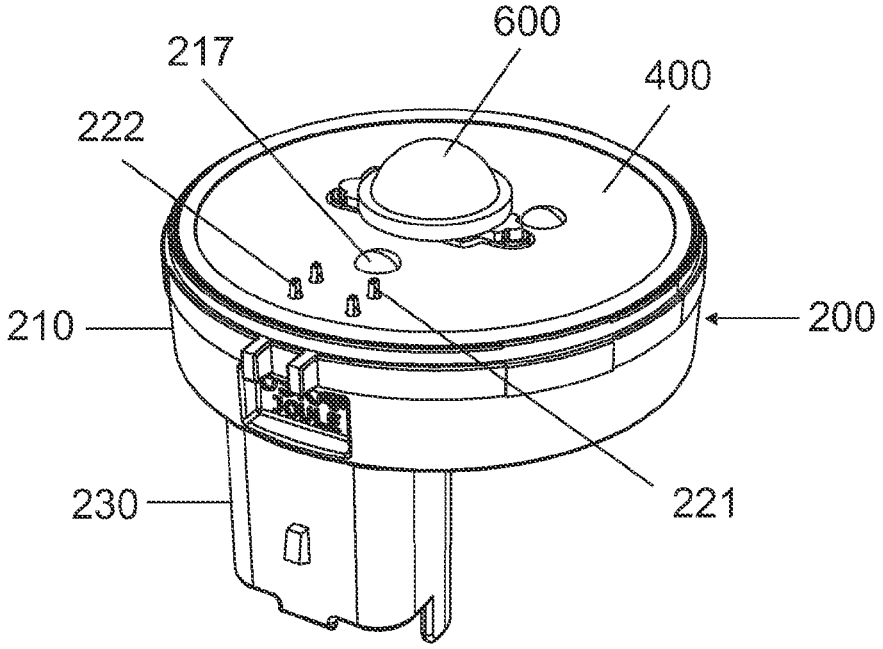
FIG. 9 shows a perspective view of the illumination unit illustrated in FIG. 1 with all its components in the assembled state

FIG. 9 depicts the illumination device according to the first exemplary embodiment of the invention with all its individual parts in the assembled state.

Figure 13:
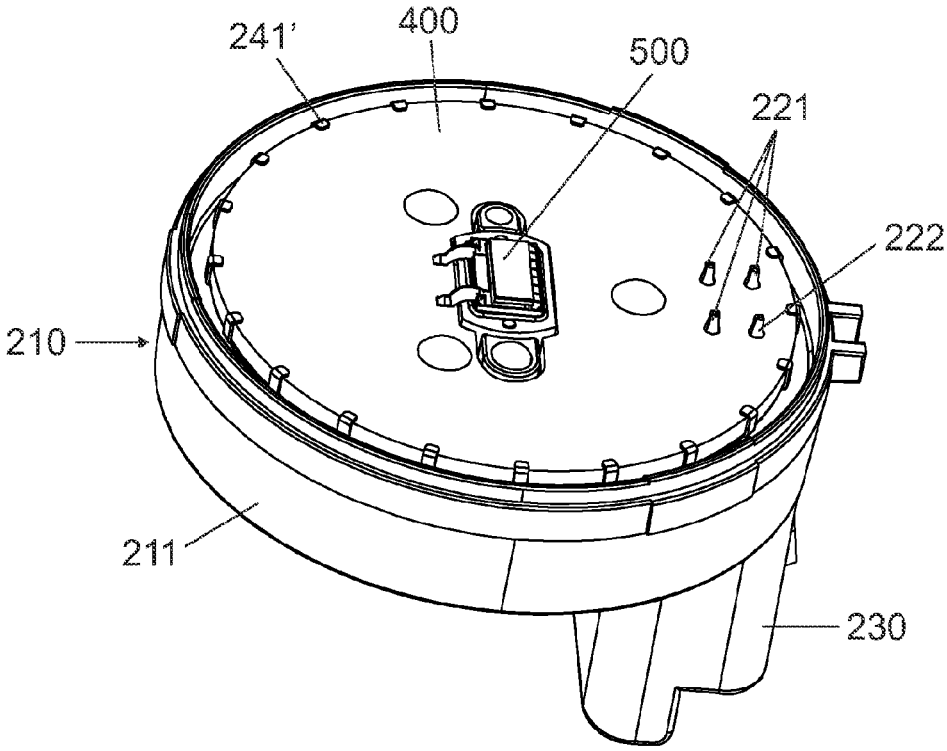
FIG. 13 shows a perspective view of the illumination unit according to the second exemplary embodiment of the invention
Figure 14:
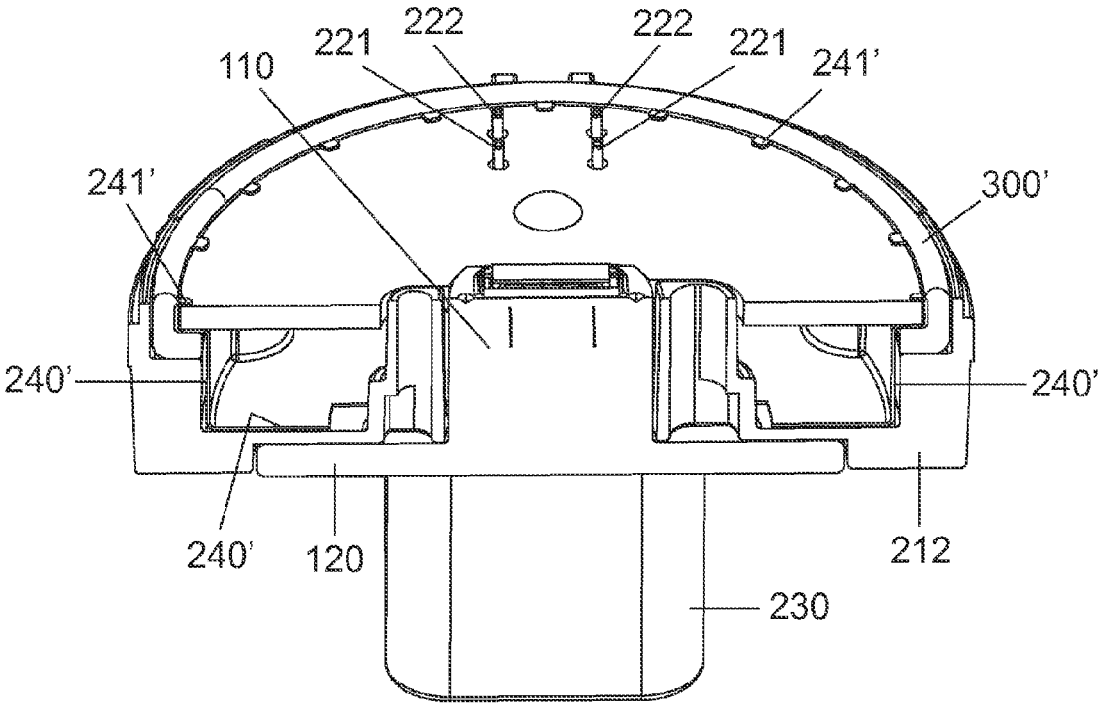
FIG. 14 shows a cross-section through the illumination unit illustrated in FIG. 13

The illumination unit according to the second exemplary embodiment of the invention is schematically illustrated in FIGS. 13 and 14. Essentially, it is only distinguished from the illumination unit according to the first exemplary embodiment by the electromagnetic shielding means and the shape of the sealing ring. In all other details the illumination units according to the first and second exemplary embodiment are a match. Accordingly, the same reference signs as in FIGS. 1 to 12 are used in FIGS. 13 and 14 for components of the second illumination unit which are identical to the corresponding components of the first illumination unit.

In the case of the illumination unit according to the second exemplary embodiment, instead of the aluminum coating 240 of the inside of the base 212, the side wall 211 and the supporting surface of the collar 218 according to the first exemplary embodiment of the inventive illumination unit, a bowl-shaped metal sheet 240' embodied as a deep-drawn component, for example an aluminum sheet or a galvanized steel sheet or a brass sheet, is used as shielding means together with the electrically conductive metal layer 410 of the assembly board 400. The bowl-shaped metal sheet 240' bears against the inside of the base 212 and the side wall 211 of the hollow cylindrical housing section 210. The bowl-shaped metal sheet 240' also has an annular supporting surface which is aligned parallel to the base 212 and on which the assembly board 400 with its annular electrical contact surface 440 is seated. In addition the bowl-shaped metal sheet 240' is provided with many hooks 241' which grip around the edge of the assembly board 400 in the manner of a flange such that the assembly board 400 is fixed to the bowl-like metal sheet 240'. The annular electrical contact surface 440 of the assembly board 400 adjoining the metal sheet 240' establishes an electrically conductive connection between the metal sheet 240' and the inner metal layer 410 of the assembly board 400 lying at ground reference potential. As a result the bowl-shaped metal sheet 240' and the inner metal layer 410 of the assembly board 400 form an electromagnetically shielded space into which the electrical components mounted on the underside 420 of the assembly board 400 (not shown) of the operating circuit protrude. For the sake of simplicity the annular contact surface 440 has not been depicted in FIGS. 13 and 14. However, the assembly board 400 shown in FIGS. 13 and 14 has the structure depicted in FIG. 10. In particular, the annular contact surface 440 extends over the edge of the assembly board 400 onto both sides 420, 430 of the assembly board 400. Between the side wall 211 and the bowl-shaped metal sheet 240' as well as the edge of the assembly board 400 a silicone ring 300' is arranged which serves to seal the illumination unit and dome-shaped secondary lens system (not shown) which is placed on the upper side or on the edge of the side wall 211. The silicone ring 300' has an L-shaped profile and is seated on the collar 218 on the inside of the hollow cylindrical housing section 210 of the plastic housing 200 of the illumination unit.

The invention is not restricted to the exemplary embodiments of the invention explained in more detail above. For example, instead of the metallization 240 of the inside of the hollow cylindrical housing section 210 according to the first exemplary embodiment of the invention and the bowl-shaped metal sheet 240' according to the second exemplary embodiment of the invention, as shielding means, the hollow cylindrical housing section 210 can be made of electrically conductive plastic in order to ensure, in combination with the inner metal layer 410 of the assembly board 400, electromagnetic shielding of the housing interior space. In this case the hollow cylindrical housing section 210 and the housing section 230 embodied as a connector are made of different plastic materials, since an electrically insulating material is necessary for the housing section 230 embodied as a connector on account of the electrical terminals embodied therein. Nevertheless, both housing sections 210 and 230 can be produced as plastic injection-molded parts that are permanently joined to each other.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. An illumination unit for vehicle headlights, the illumination unit comprising:

a light-emitting diode device, a housing and an assembly board on which components of an operating circuit for operating the light-emitting diode device are arranged, wherein the housing is made of plastic and a section of the housing is embodied as connector comprising electrical terminals which are electrically connected to metal pins serving as electrical contact pins and protruding through drilled holes in the assembly board, wherein the housing and the assembly board define an interior space, wherein the assembly board has at least one electrically conductive inner layer that is connected to a ground reference potential of the operating circuit and on its surface the assembly board has at least one electrical contact surface which is contacted with at least one electrically conductive inner layer by means of one of the metal pins passing through the electrical contact surface and the electrically conductive inner layer, and the housing has an electromagnetic shielding structure configured to provide electromagnetic shielding of the interior space, wherein the electromagnetic shielding structure comprises a metallization of the housing which connected to the at least one electrical contact surface.

2. The illumination unit as claimed in claim 1, wherein the at least one electrical contact surface is embodied as ring-shaped.

3. The illumination unit as claimed in claim 1, wherein the metallization comprises the part of the housing enclosing the interior space.

4. The illumination unit as claimed in claim 1, wherein the metallization is embodied as a metallic coating on the inside of the housing in the area of the interior space.

5. The illumination unit as claimed in claim 1, wherein the metallization extends onto a supporting surface of the housing on which the at least one electrical contact surface of the assembly board is disposed.

6. The illumination unit as claimed in claim 1, wherein the electrical contact surface is annular.

7. An illumination unit for vehicle headlights, the illumination unit comprising: a light-emitting diode device, a housing and an assembly board on which components of an operating circuit for operating the light-emitting diode device are arranged, wherein the housing is made of plastic and a section of the housing is embodied as connector comprising electrical terminals which are electrically connected to metal pins serving us electrical contact pins and protruding through drilled holes in the assembly board, wherein the housing and the assembly board define an interior space, wherein the assembly board has at least one electrically conductive inner layer that is connected to a ground reference potential of the operating circuit and on its surface the assembly board has at least one electrical contact surface which is connected with at least one electrically conductive layer by means of one of the metal pins passing through the electrical contact surface and the electrically conductive inner layer, and the housing, has an electromagnetic shielding structure configured to provide electromagnetic shielding of the interior space, wherein the electromagnetic shielding structure comprises at least one structure selected from a group consisting of: metal sheet, metal lattice, metal mesh; and metal film which is connected to the at least one electrical contact surface.

8. The illumination unit as claimed in claim 7, wherein the electromagnetic shielding structure is embodied in a bowl-like manner and arranged in the interior space.

9. The illumination unit as claimed in claim 7, wherein the electromagnetic shielding structure bears against the at least one electrical contact surface of the assembly board.

10. The illumination unit as claimed in claim 7, wherein the electromagnetic shielding structure is fixed to the assembly board by means of a technology from the group consisting of: flanging, laser welding, adhesive bonding, soldering and force fitting.

* * * * *

UNITED STATES PATENT AND TRADEMARK OFFICE

CERTIFICATE OF CORRECTION

PATENT NO. : 8,870,426 B2
APPLICATION NO. : 13/259188
DATED : October 28, 2014
INVENTOR(S) : Alois Biebl et al.

It is certified that error appears in the above-identified patent and that said Letters Patent is hereby corrected as shown below:

In the Claims

Column 12, line 27-28, Claim 7, delete “pins serving us” and write “pins serving as” in place thereof.

Signed and Sealed this
Fifth Day of May, 2015

Michelle K. Lee

Michelle K. Lee
*Director of the United States Patent and Trademark Office*